United States Patent [19]

Shibuya

[11] 4,383,466

[45] May 17, 1983

[54] STRING BRIDGE OF ELECTRIC GUITAR

[75] Inventor: Hisatake Shibuya, Tokyo, Japan

[73] Assignee: ESP Co., Ltd., Tokyo, Japan

[21] Appl. No.: 298,298

[22] Filed: Aug. 31, 1981

[51] Int. Cl.[3] ..... G10D 3/12

[52] U.S. Cl. ..... 84/313

[58] Field of Search ..... 84/313

[56] References Cited

U.S. PATENT DOCUMENTS 2,741,146 4/1956 Fender ..... 84/313

3,411,394 11/1968 Jones ..... 84/313

*Primary Examiner*—Lawrence R. Franklin

*Attorney, Agent, or Firm*—Toren, McGeady and Stanger

[57] ABSTRACT

A string bridge for an electric guitar includes a bridge main part formed by a generally rectangular top portion which pivots about a forward edge thereof to produce a tremolo effect, and by an integral stem portion arranged to extend vertically downwardly from the top portion into a bore in the sound body of the guitar. The lower part of the stem portion is biased by a spring mechanism at an initial position whereat the stem portion abuts a confronting surface of the bore. The pivot axis of the bridge main part is held steady relative to the sound body by way of an elongate member fixed on the body, and vibrations which would otherwise occur in the bridge main part when no tremolo effect is desired, are suppressed by the abutment of the stem portion against the confronting surface of the bore in the sound body.

2 Claims, 5 Drawing Figures

STRING BRIDGE OF ELECTRIC GUITAR

BACKGROUND OF THE INVENTION

This invention relates to an electric guitar, and more particularly a string bridge in an electric guitar of the type having mechanisms for producing tremolo.

In playing rock and jazz by an electric guitar, tremolo is one of the most important playing techniques. This tremolo is produced, with reference to FIG. 1 for example, by swinging a string bridge A which is mounted to a sound body 9 so as to be rotatable about its longitudinal axis. In actual play, while strings 16 are touched, the bridge is swung by the small finger operating an arm bar 4 which is fitted to the bridge, whereby the bridge is brought away from or nearer to the sound body so as to have the strings tensioned or loosed.

In a conventional electric guitar of the aforementioned kind which is provided with tremolo producing mechanisms, a string bridge, a vertically extending stem portion of which is mounted to a sound body, has an outer bridge portion the leading edge of which is tapered and provided with holes having diameters larger than the diameter of screws to be inserted into the holes. In addition, as the screws for the tapered leading edge are somewhat loose so that the leading edge can operate within its tapered angle, the actuation of the arm bar fitted to the string bridge can swing the bridge using the screws as a fulcrum, whereby the strings are tensioned or loosened. These kinds of tremolo producing bridge arrangements are, however, accompanied with the following drawbacks. As the screw holes have diameters larger than those of the screws, the fulcrum point can hardly be stable, in spite of repeated tuning. And, as the screws are set loosely so that the bridge can operate, they can come out easily.

SUMMARY OF THE INVENTION

In the string bridge of an electric guitar which is made in accordance with this invention, a leading edge portion of the bridge, which is independent from a main bridge portion, extends transversely to a sound body and a neck. The leading edge portion is firmly screwed onto the sound body, while the main bridge portion including a vertically extending stem portion mounted within the sound body, is pivotally supported at its forward ends by the free ends of shafts which are fitted to the lateral ends of the leading edge portion and extend along its axis. Thus, the main bridge portion is rotatably fitted to the stationary leading edge portion thereof, whereby the operation of an arm bar fitted to the main bridge portion can provide a predetermined rotary swinging motion of the main bridge portion about the shafts fitted to the leading edge portion, and said operation can change the tension of the strings. With the present structure, the bridge always has a constant axial center of swinging motion. This can assure stable tuning, and produce the tremolo which one desires to play.

DETAILED DESCRIPTION OF THE INVENTION

Figure 1:
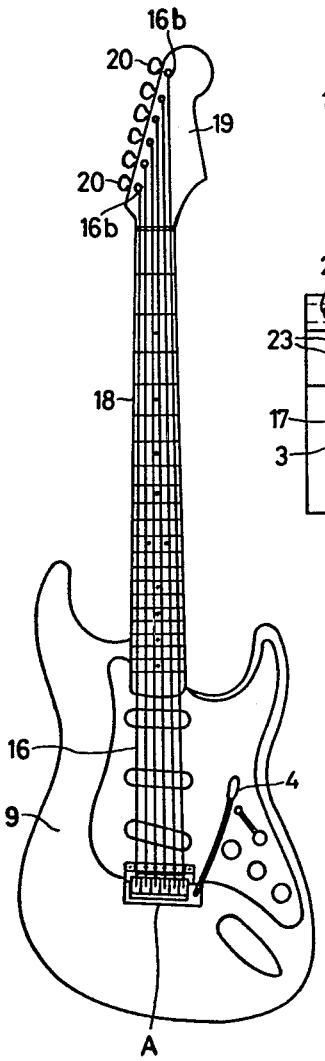
FIG. 1 is a general view of n electric guitar with the string bridge made in accordance with this invention.
Figure 2:
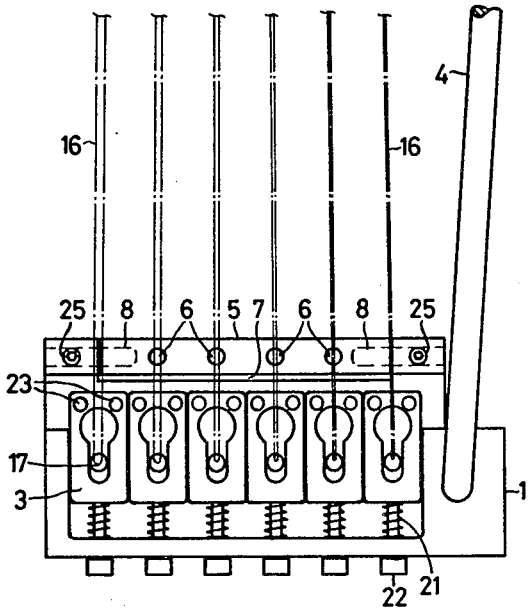
FIG. 2 is an enlarged front view of the string bridge.

A main string bridge body 1 has a stem portion 2 which is integral with the main body and extends vertically downwardly from said main body. The stem portion 2 is inserted within a through bore 10 in a sound body 9. On the upper surface of the bridge main body 1, there are mounted, in parallel to each other, six tuning bridge pieces 3 the rear end of each piece being fitted with a screw 22. This screw 22 is mounted with a coil spring 21 and has a head engaging with a rear wall of the bridge main body 1. By turning said screw, each tuning bridge piece 3 can be minutely moved forward or rearward. Side walls of the bridge main body 1 urge the tuning bridge pieces 3 to locate side by side and very closely to each other. A pair of screws 23 are fitted to a forward end of each tuning bridge piece 3 so as to extend vertically in said pieces, whereby the distance between each of the strings 16 and a neck 18, viz., the height of strings can freely be varied by the adjustment of screws 23. a tremolo producing arm bar 4 is fitted to the bridge main body 1 so as to extend above one side of the sound body 9.

A member 5 corresponds to the leading edge portion referred to in the Summary of the Invention. This member serves to fix the bridge main body 1 to the sound body 9 for swinging movement, and has an elongate configuration. There are provided in said member 5 a plurality of holes 6 which extend through the member. This member 5 is inserted in an elongated cutout 7 which is provided centrally in the forward end of the bridge main portion 1, and both of its lateral ends are pivotally supported by short shafts 8 which are fitted in the forward end of the main bridge portion 1 so as to be transverse with respect to the sound body 9 and the neck 18.

The string bridge A having the above construction is assembled to the sound body 9, as follows.

Figure 3:
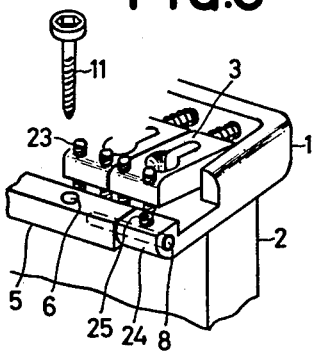
FIG. 3 is an enlarged perspective view of the principal part of the bridge.

The string bridge A with the member 5 facing the head 19 is mounted with its vertically extending portion 2 in the bore 10, and is firmly fixed to the sound body 9 at its member 5 by fastening the screws 11 through the holes 6 to a part of the sound body which is located forwardly and adjacent to the outer front edge of the bore 10. It shall be noted, as illustrated in FIG. 3, the lower forward edge corners of the bridge main body 1 are rounded at 24, so that said corners shall not abut against the outer surface of body 9 when the bridge body is swung about the shafts 8, and so that the bridge main body can make a smooth rotary movement.

The bore or opening 10 which extends vertically through the sound body 9 has, as explained above, room sufficient enough to allow the vertically extending portion 2 to swing down and up. A coil spring 14 extending within another opening 12 which communicates with the bore 10 and extends horizontally to the sound body 9 so as to open at a bottom surface of the body 9, has an end fitted to the front wall 13 of the opening 12 and the other end fitted to the lower end of the vertically extending portion 2. On account of the tension force of said spring 14, the bridge A is normally biased so as to make the forward surface of portion 2 abut against the confronting surface 15 of bore 10.

Each of the strings 16 is fixed at its base end 16*a* to the lower end of the vertically extending stem portion 2, then it passes through a vertically extending through hole 17, runs over the forward edge of tuning bridge piece 3, and at its forward terminal 16*b* is wound up around a peg 20 of the head 19, whereby the strings are stretched over the neck 18. Screws 25 are provided for fixing each shaft 8 with respect to the bridge body, and a cover plate 26 is fitted over the opening 12.

The guitar having the string bridge as mentioned above affords the following advantageous points.

Figure 4A:
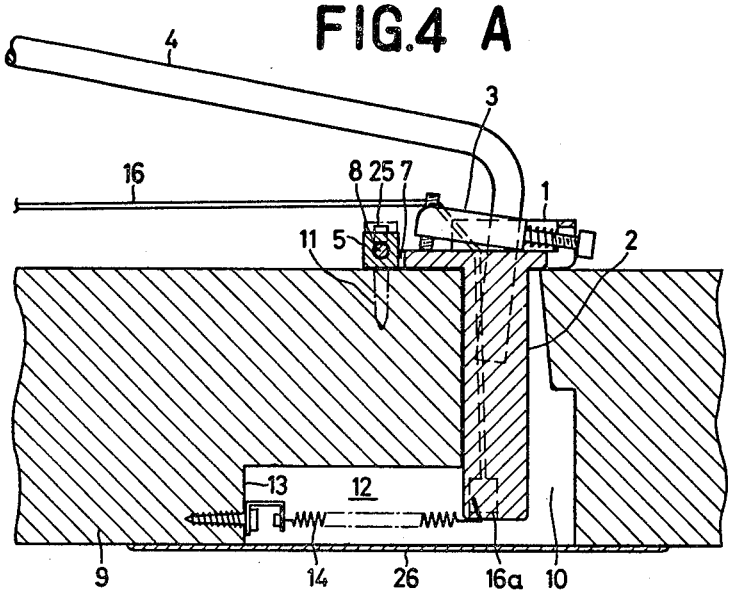
FIGS. 4A and 4B are enlarged sectional views of the guitar in part, which illustrate the operation of the bridge.
Figure 4B:
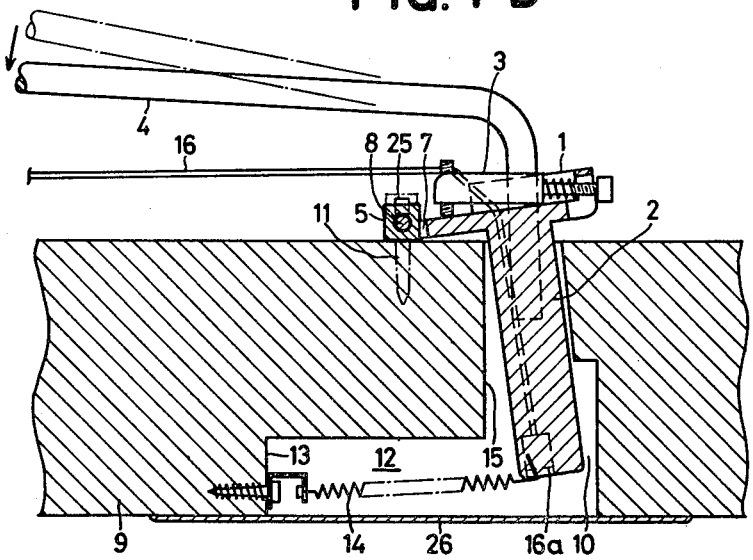

When the arm bar 4 is pressed by a finger toward the upper surface of body 9 (FIG. 4A) for producing tremolo, the bridge main body 1 rotates about the short shafts 8 which project into the elongate member 5 which is in turn firmly fixed by the screws 11 to the surface of sound body 9. This means that the bridge 1 always makes a rotary movement about a constant pivot axis, whereby the bridge will not be unstable, and one can play a guitar with sounds as tuned beforehand. The pivotal movement of bridge 1 can smoothly produce tremolo with less finger pressure than that in conventional guitars. Hence, this invention can provide string bridges of relatively simple construction and which have nevertheless the above various advantageous points.

I claim:

1. A string bridge for an electric guitar which includes a sound body having a bore extending vertically between the top and bottom surfaces of the sound body, said string bridge comprising a bridge main part including a generally rectangular top portion arranged to extend transversely of the axis of the guitar for receiving the guitar strings and for pivoting about a forward edge of said top portion to produce a tremolo effect, said bridge main part also including an integral stem portion arranged to extend vertically downwardly of said top portion into the bore in the sound body so that said stem portion can be swung together with said top portion from an initial position at which said stem portion abuts a confronting surface of the bore, spring means connected between the lower part of said stem portion and the sound body for biasing said stem portion at said initial position, an elongate member arranged to be fixed to the top surface of the sound body so as to extend transversely of the axis of the guitar, a pair of pivot shafts arranged to extend outwardly from the ends of said elongate member coaxially with one another, said top portion including a pair of arms extending from the ends of its forward edge for pivotally engaging said pair of pivot shafts and for defining an elongated cutout in said forward edge within which cutout said elongated member is located.

2. A string bridge according to claim 1, wherein each of said pair of arms extending from said top portion has a lower forward edge corner which is rounded so that said forward edge corner remains out of abutting contact with the top surface of the sound body when said top portion of said bridge main part is swung about said pivot shafts in order to produce said tremolo effect.

* * * * *